US005971643A

United States Patent [19]

Ahmed

[11] Patent Number: 5,971,643

[45] Date of Patent: Oct. 26, 1999

[54] MULTIPLE CARTRIDGE RAINBOW PEN

[76] Inventor: Cindy G. Ahmed, P.O. Box 4776, Key West, Fla. 33041

[21] Appl. No.: 09/102,106

[22] Filed: Jun. 22, 1998

[51] Int. Cl.[6] ..... A46B 11/00

[52] U.S. Cl. ..... 401/44; 401/198

[58] Field of Search ..... 401/44, 45, 47, 401/35, 23, 28, 34, 198, 199

[56] References Cited

U.S. PATENT DOCUMENTS

| | | | |
|---|---|---|---|
| 3,887,287 | 6/1975 | Rosh, Jr. | 401/35 |
| 4,723,859 | 2/1988 | Kitoh | 401/35 |
| 5,306,092 | 4/1994 | Jenq | 401/35 |
| 5,368,405 | 11/1994 | Sixiong | 401/35 |
| 5,388,924 | 2/1995 | Chao | 401/35 |

*Primary Examiner*—David J. Walczak
*Attorney, Agent, or Firm*—Robert J. Van Der Wall

[57] ABSTRACT

A marker apparatus for placing an elongate mark on a marking medium surface, including a first chamber having a first chamber proximal end, a first chamber distal end with a first chamber wick port, and containing a first pigmented marking liquid; a second chamber having a second chamber proximal end, a second chamber distal end with a second chamber wick port, and containing a second pigmented marking liquid; a first wick segment in liquid communication with the first pigmented marking liquid protruding from the first chamber wick port for contact with a surface of a marking medium; a second wick segment in liquid communication with the second pigmented marking liquid protruding from the second chamber wick port for contact with a surface of a marking medium; and a chamber retaining structure retaining the first chamber and the second chamber so that the first wick segment is positioned substantially adjacent to the second wick segment. The chamber retaining structure preferably includes an open-ended housing containing the first and second chambers. The first and second wick segments protrude from the housing opening.

17 Claims, 3 Drawing Sheets

MULTIPLE CARTRIDGE RAINBOW PEN

BACKGROUND OF THE INVENTION

1. Field of the Invention

The present invention relates generally to the field of writing and printing equipment. More specifically the present invention relates to a marking apparatus including an open-ended elongate housing containing a plurality of chambers filled with pigmented marking liquid, the marking liquid within the first chamber having a pigment different from that of the marking liquid within the second, and possible third, chamber.

A porous wick segment extends into a wick port in each of the plurality of chambers and protrudes from the housing opening. The wick segments join to form a nib to simultaneously deposit adjacent overlapping trails of both marking liquids onto a marking medium such as paper, to create a mark with a blended array of color that may resemble a rainbow like effect. That is because the nib has a rectilinear and continuous marking end, in which the edges of color trails of the differently pigmented liquids blend together slightly. As a result the array of color trials deposited onto the marking medium are pure at their mid-regions, where primary colors may appear, but overlap at their edges, where they may form secondary colors. Alternatively, notches may be provided in the nib marking end to separate the deposited color trails. The wick segments and marking segment are all preferably made of felt, although use of other materials is contemplated. The marking liquid is preferably either ink or paint.

2. Description of the Prior Art

There have long been pens and markers filled with pigmented liquid for depositing a trial of the liquid onto a medium surface. Most prior pens, for example, contain a single pigmented liquid. A few contain multiple ink cartridges, but only one of these at a time may be selected for writing. Thus, while the many available pigments have provided numerous color choices, all known prior pens and markers deposit only one distinct color of liquid at a time.

It is thus an object of the present invention to provide a marking apparatus which simultaneously deposits multiple liquids containing different pigments in parallel, adjacent overlapping trails, to create a mark with a rainbow appearance.

It is another object of the present invention to provide such an apparatus which has separate and independently replaceable liquid chambers.

It is still another object of the present invention to provide such an apparatus in which adjacent primary color trails may blend together at their edges to create secondary colors, or may remain separate and distinct.

It is finally an object of the present invention to provide such an apparatus which is compact, reliable and inexpensive.

SUMMARY OF THE INVENTION

The present invention accomplishes the above-stated objectives, as well as others, as may be determined by a fair reading and interpretation of the entire specification.

A marker apparatus is provided for placing an elongate mark on a marking medium surface, including an open-ended elongate housing containing a plurality of chambers filled with pigmented marking liquid, the marking liquid within the first chamber having a pigment different from that of the marking liquid within the other chamber(s). A porous wick segment extends into a wick port in each of the chambers and protrudes outwardly through the housing opening. The wick segments join to form a nib to simultaneously deposit adjacent overlapping trails of both marking liquids onto a marking medium such as paper, to create a mark with a blended array of color that may resemble a rainbow like effect. The marker apparatus further includes a chamber retaining structure positioning the chambers so that the wick segments are disposed adjacent to each other.

The chamber retaining structure preferably includes an open-ended housing containing the plurality of chambers. The plurality of wick segments protrude from the housing opening. The wick segments preferably merge into a common marking nib protruding from the housing opening. The apparatus optionally additionally includes liquid transfer wicks extending from the wick segments and passing into the chamber wick ports and into contact with the pigmented marking liquids within the chambers. The apparatus optionally additionally includes a cross-sectional mounting structure within the housing having a plurality of mounting structure passageways through which the plurality of liquid transfer wicks pass. The marking liquids are preferably either ink or paint.

The apparatus alternatively includes a wick divider element. If so, the wick segments are positioned adjacent to opposing sides of the wick divider element for depositing fully separated trails of the pigmented marking liquids onto the marking medium. In still another alternative, the wick segments emerge from the chamber retaining structure laterally separated from each other to deposit marking liquid onto the marking medium in separate trails. The wick segments are preferably made of felt.

The chambers are preferably separate tubular vessels, each removably mounted within the housing. The housing has a housing wall, and optionally additionally includes spacer flanges protruding laterally into the housing from the housing wall to retain the chambers against movement relative to the housing. Each chamber preferably tapers to the chamber wick port, and the position of each of the chamber wick ports relative to the longitudinal axis of each of the chambers is such that the chamber wick ports are laterally spread from each other within the housing.

The housing preferably additionally includes an access opening and a housing lid removably fitted to the access opening. The apparatus preferably still additionally includes air pressure equalizing vents in the housing and in the chambers for admitting air to replace the volume of the marking liquid discharged from the chambers during marking. The nib preferably has a rectilinear and continuous marking end, in which lateral edges of color trails of the differently pigmented marking liquids blend together, so that the trails of marking pigmented liquids deposited onto the marking medium surface produce colors which are pure at their mid-regions, but overlapping at their edges. The nib alternatively has a rectilinear marking end which additionally includes notches at the marking end which separate nib liquid passing regions to produce on the marking medium surface an array of separate and distinct color trails laterally separated from each other.

BRIEF DESCRIPTION OF THE DRAWINGS

Various other objects, advantages, and features of the invention will become apparent to those skilled in the art from the following discussion taken in conjunction with the following a drawings, in which.

DETAILED DESCRIPTION OF THE PREFERRED EMBODIMENTS

Figure 1:
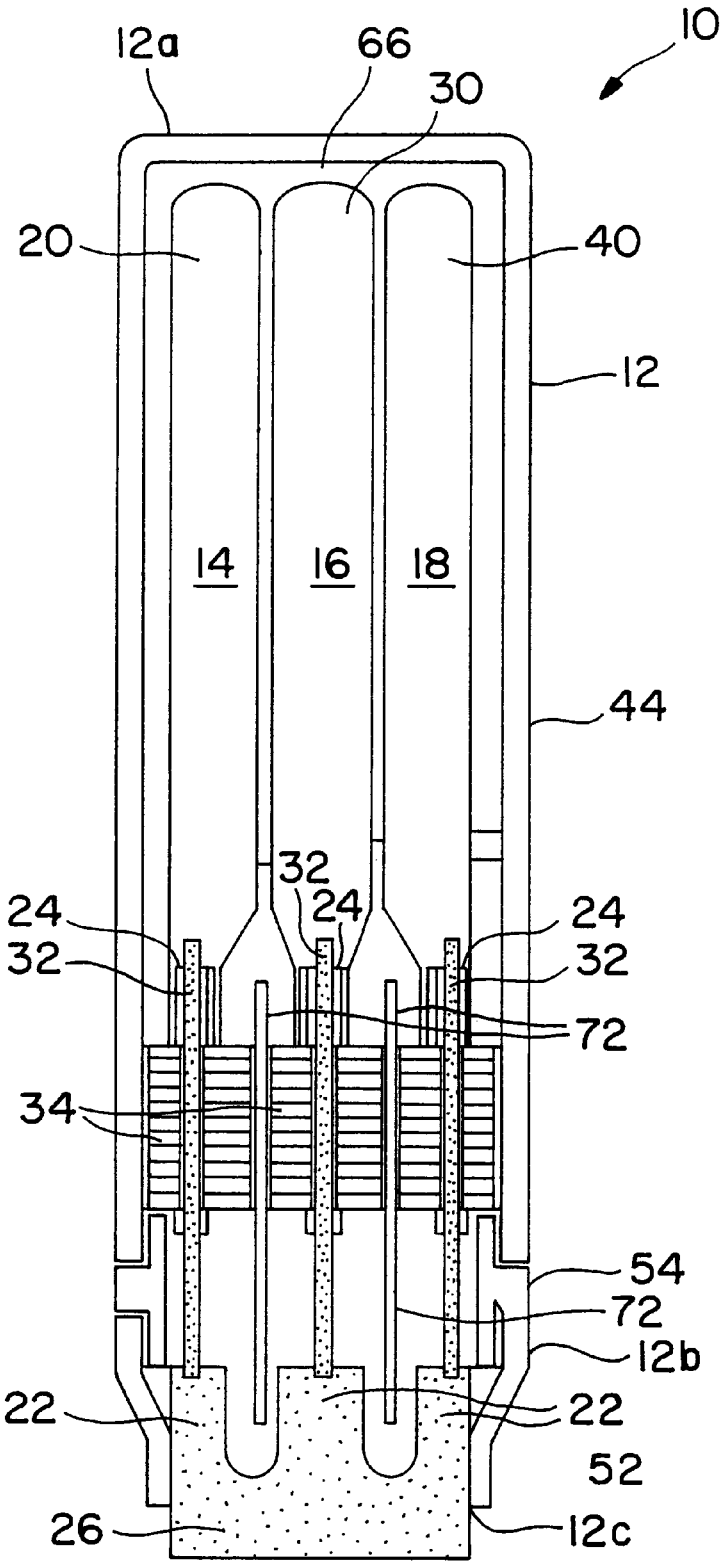
FIG. 1 is a cross-sectional front view of a three chamber embodiment of the marking apparatus.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various Figures are designated by the same reference numerals.

First Preferred Embodiment

Figure 2:
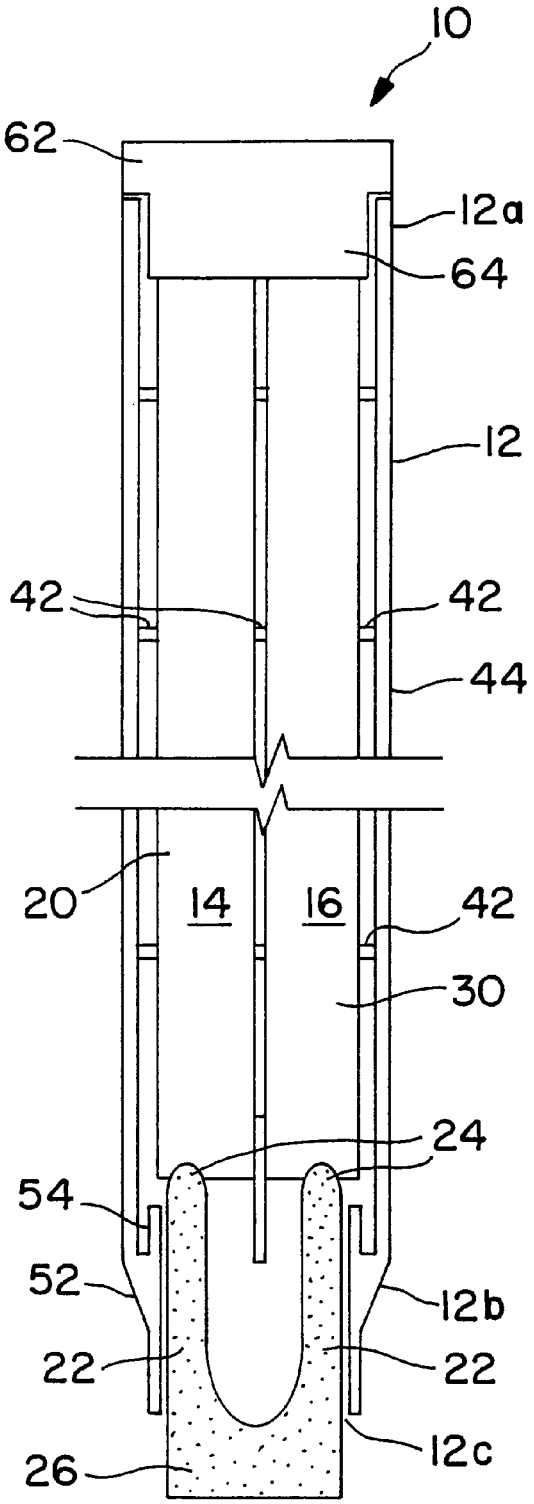
FIG. 2 is a view as in FIG. 1 of a two chamber embodiment of the apparatus having the removable housing lid for replacement of the marking liquid chambers.
Figure 3:
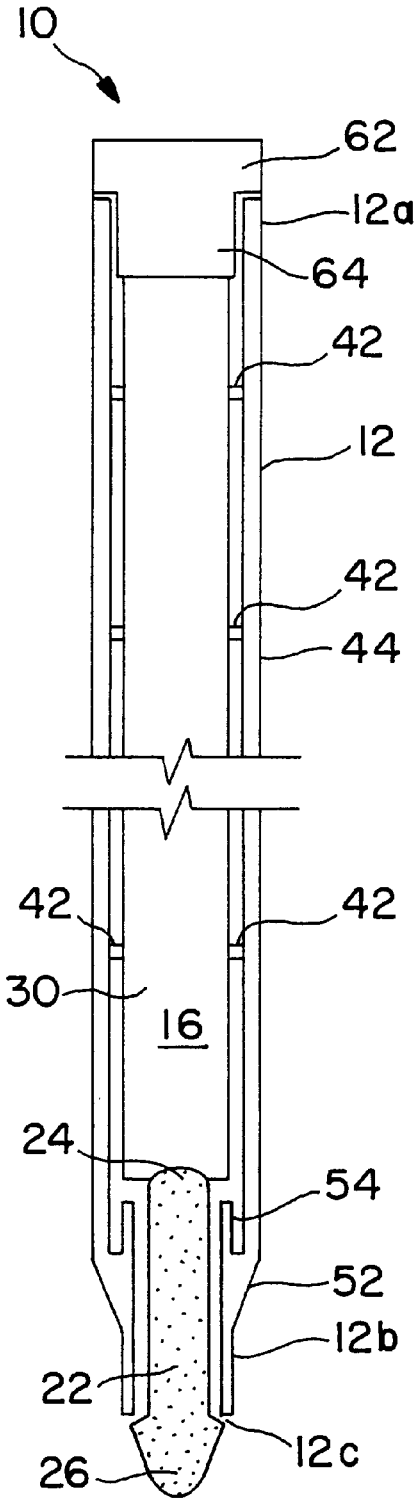
FIG. 3 is a cross-sectional side view of the apparatus of FIG. 2.
Figure 4:
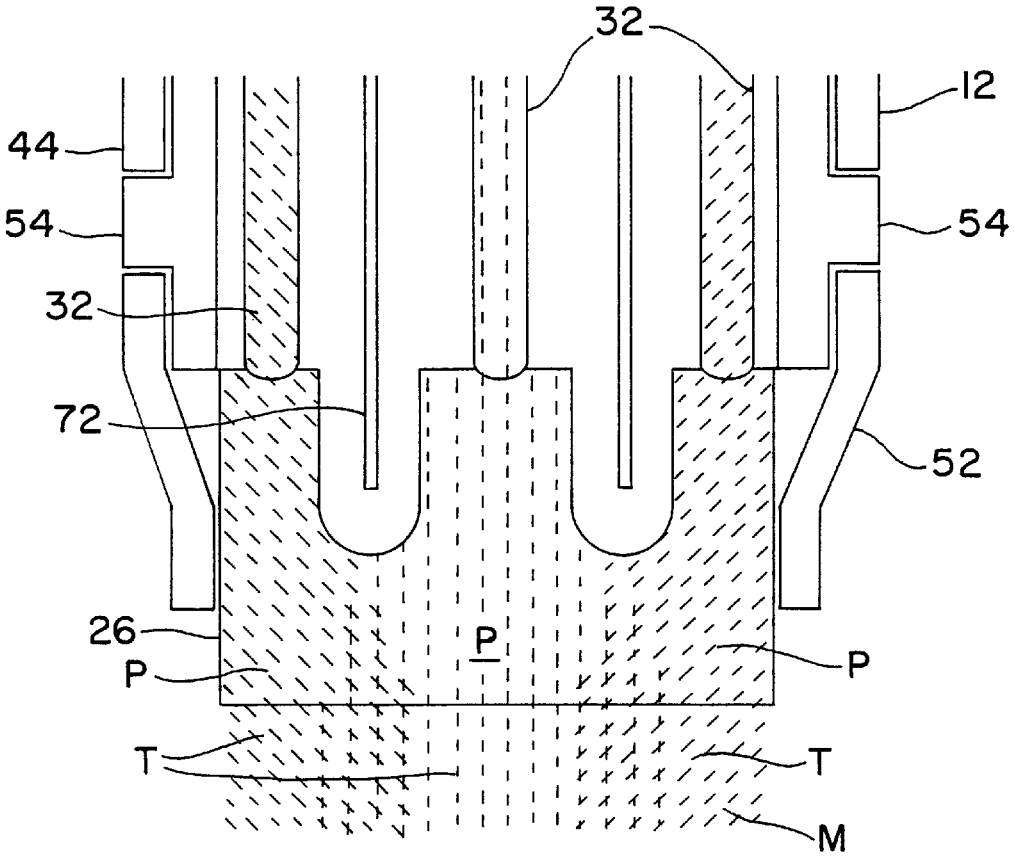
FIG. 4 is a broken away, close-up cross-sectional view of the nib end of the apparatus with the solid nib leaving color trails which blend at their lateral edges.
Figure 5:
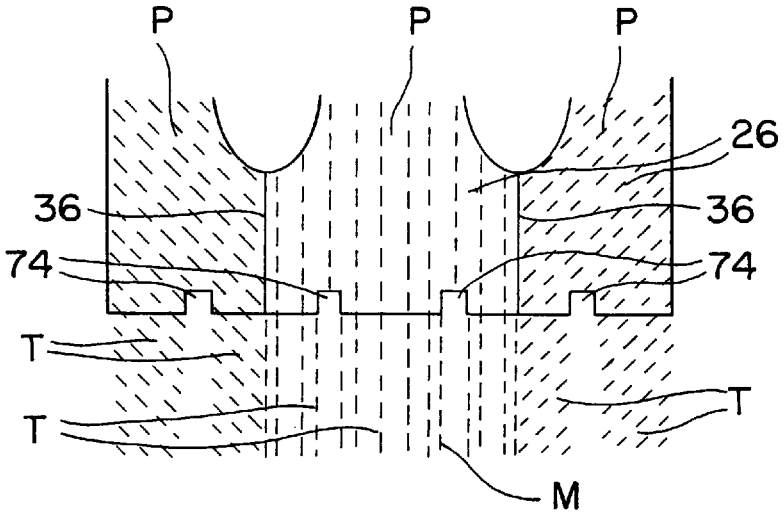
FIG. 5 is a broken away, close-up cross-sectional view of the nib only, where the nib includes the optional divider elements, leaving trails of separate and distinct colors.

Referring to FIGS. 1–5, a marking apparatus 10 is disclosed, including an elongate housing 12 with a housing closed end 12*a* and a housing open end 12*b* with a housing opening 12*c*. Housing 12 retains a first chamber 20 containing a first pigmented marking liquid 14, a second chamber 30 containing a second pigmented marking liquid 16, and a third chamber 40 containing a third pigmented marking liquid 18. Additional chambers may be provided. The first, second and third marking liquids 14, 16 and 18, respectively, each preferably contain a pigment different from those of other two liquids. A porous wick segment 22 extends into a wick port 24 in each of the first, second and third chambers 20, 30 and 40 and passes through housing opening 12*c* for making contact with a marking medium M surface.

The wick segments 22 preferably merge into a common marking nib 26 extending outwardly through housing opening 12*c*. In this instance, wick segments 22 preferably each include a liquid transfer wick 32 extending longitudinally into a wick port 24 and into contact with pigmented marking liquid within the given chamber 20, 30 or 40. A cross-sectional mounting structure 34 is preferably provided within the housing 12 and has mounting structure passageways through which each one of the liquid transfer wicks 32 pass. Mounting structure 34 may be liquid permeable and divided into individual chamber sections by liquid impermeable dividers 72.

First, second and third chambers 20, 30 and 40, respectively, are preferably separate tubular vessels, each removably mounted within housing 12. Spacer flanges 42 preferably protrude laterally into housing 12 from the housing wall 44 to retain chambers 20, 30 and 40 against movement relative to housing 12. Each chamber preferably tapers to a narrow wick port 24 at its end, and the position of the wick port 24 relative to the chamber longitudinal axis is selected to laterally spread the ports 24 from each other as much as possible within housing 12.

Housing 12 preferably has a housing tip segment 52 at the housing distal end 12*b* which is removably mounted onto a friction ring element 54 fit within the mouth of the remainder of the housing 12. Removal of the tip segment 52 permits removal and replacement of the nib 26 and wick segments 22. A housing lid 62 is provided which fits snugly into a lid port 64 in housing proximal end 12*a*. See FIGS. 2 and 3. Mounting structure 34 may be pulled out of housing 12 for access to and replacement of spent chambers 20, 30 and 40. Very narrow air pressure equalizing vents 66 are provided in housing 12 and in the chambers to permit air to replace the volume of liquid discharged during marking. As a result, air at atmospheric pressure continuously surrounds the chambers, wick segments 22 and nib 26.

Pigmented liquids 14, 16 and 18 flow through nib 26 along substantially linear and separate longitudinal paths P to a marking medium M moving relative to and in contact with the nib 26, where they are continuously deposited in adjacent trails T. Nib 26 may have a straight and continuous marking end, in which the edges of color trails T of the differently pigmented liquids blend. As a result the trails T of colors deposited onto marking medium M are pure at their mid-regions, where primary colors may appear, but overlap at their edges, where they may form secondary colors. See FIG. 4.

Wick segments 22 alternatively are joined to opposing sides of wick divider elements 36. See FIG. 5. The result is a lateral array of adjacent and yet fully distinct colors. Wick segments 22 still alternatively emerge through housing opening 12*c* entirely disconnected from each other. Yet another variation is the provision of notches 74 at the nib 26 marking end between the nib color passing regions paths P, which produces on the marking medium M an array of separate and distinct color trails, the trails being laterally separated from each other.

The wick segments 22 and marking nib 26 are all preferably made of felt, although use of other suitable materials is contemplated. The marking liquids 14, 16 and 18, respectively, are preferably either ink or paint.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

What is claimed is:

1. A marker apparatus for placing an elongate mark on a marking medium surface, comprising:

a housing having an opening at one end;

a plurality of chambers disposed within the housing and respectively containing a plurality of differently pigmented marking liquids;

a plurality of wick segments that merge into a nib in liquid communication with the pigmented marking liquids and protruding from the housing opening for contact with a marking medium;

wherein the nib has a rectilinear marking end, additionally comprising notches at said marking end which separate nib color passing regions to produce on the marking medium surface an array of separate and distinct pigmented color trails laterally separated from each other.

2. The apparatus of claim 1 which further comprises a plurality of wick ports disposed respectively in the plurality of chambers and through which the plurality of wick segments pass.

3. The apparatus of claim 2, wherein each of the chambers tapers to its wick port, and wherein the position of each wick port relative to a longitudinal axis of each chamber is such that the wick ports are laterally separated from each other within the housing.

4. The apparatus of claim 3 which further comprises liquid transfer wicks extending from the wick segments and passing into the wick ports and into contact with the pigmented marking liquids within the chambers.

5. The apparatus of claim 1, wherein the chambers are separate tubular vessels, each removably mounted within the housing.

6. The apparatus of claim 1 which further comprises an access opening in a closed end of the housing and a housing lid removably fitted to the access opening.

7. The apparatus of claim 1 which further comprises a cross-sectional mounting structure within the housing having a plurality of mounting structure passageways through which the wick segments pass.

8. The apparatus of claim 7 in which the cross-sectional mounting structure is liquid permeable and divided into individual chamber sections by liquid impermeable dividers.

9. The apparatus of claim 7 in which in which the cross-sectional mounting structure is removable from the housing for access to and replacement of spent chambers.

10. The apparatus of claim 1, wherein the housing has a housing wall including spacer flanges protruding laterally into the housing from the housing wall to retain the chambers against movement relative to the housing.

11. The apparatus of claim 1 which further comprises a housing tip segment at the housing open end which is removably mounted onto a friction ring element fit within the housing opening, such that removal of the tip segment permits removal and replacement of the nib and wick segments.

12. The apparatus of claim 1, which further comprises a wick divider element, wherein the first and second wick segments are positioned adjacent to opposing sides of said wick divider element for depositing fully separated color trails of pigmented marking liquid onto the marking medium.

13. The apparatus of claim 1, wherein the plurality of wick segments protrude from the housing opening laterally separated from each other to deposit pigmented marking liquid onto the marking medium in separate color trails.

14. The apparatus of claim 1 which further comprises at least one air pressure equalizing vent in the housing and in the chambers for admitting air to replace the pigmented marking liquid discharged from the chambers during marking.

15. The apparatus of claim 1, wherein the wick segments comprise felt.

16. The apparatus of claim 1, wherein the pigmented marking liquids are ink.

17. The apparatus of claim 1, wherein the pigmented marking liquids are paint.

* * * * *